US005216967A

United States Patent [19]

Mormino

[11] Patent Number: 5,216,967

[45] Date of Patent: Jun. 8, 1993

[54] STAND-ALONE, COMMERCIAL REFUSE-BURNING APPARATUS

[76] Inventor: Sam Mormino, 2501 W. Peterson Ave., Chicago, Ill. 60659

[21] Appl. No.: 851,315

[22] Filed: Mar. 16, 1992

[51] Int. Cl.[5] ..... B09B 3/00; F23G 5/00

[52] U.S. Cl. ..... 110/235; 110/212; 110/165 R; 110/255; 110/259

[58] Field of Search ..... 110/235, 212, 255, 259, 110/258, 165 R; 126/174, 155

[56] References Cited

U.S. PATENT DOCUMENTS

| | | | |
|---|---|---|---|
| 3,855,950 | 12/1974 | Hughes, Jr. et al. | 110/255 X |
| 4,339,998 | 7/1982 | Finch | 110/255 X |
| 4,724,779 | 2/1988 | White et al. | 126/155 X |
| 4,831,940 | 5/1989 | Franza | 110/259 |
| 5,050,509 | 9/1991 | Mormino | 110/235 |

*Primary Examiner*—Edward G. Favors
*Attorney, Agent, or Firm*—Y. Judd Azulay

[57] ABSTRACT

A refuse-burning apparatus having a main combustion-housing with an interior in which refuse is placed and burned, which main combustion-housing has a plurality of substantially-upright walls, a top wall, and a lower meshed screen. One side wall has an entrance through which refuse may enter into the interior of the housing, which entrance is selectively opened and closed. A loader for loading refuse into the interior of the housing is operatively associated with the entrance, so that refuse may be inserted into the interior when the entrance is opened up. A ventilator supplies air to the interior. An after-burner is mounted to the top wall of the main housing for achieving secondary burning of the refuse, which after-burner has a main frame, at least one burner mounted to the main frame, and exhaust for directing the products of combustion from the main frame to the ambient surroundings. In the preferred embodiment, the bottom meshed screen is periodically vibrated to loosen any ash lodged therein. Mounted underneath the meshed screen is an exit conveyer for transporting the ashes falling through the meshed screen to a receiving receptacle for subsequent disposal of the ash. A pair of sloping deflector plates direct the ashes onto the conveyer belt. The receiving receptacle has a series of magnetized baffle plates for separating out metal objects from the ashes and holding them for separate disposal.

15 Claims, 2 Drawing Sheets

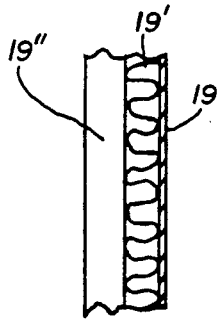
FIG. 3
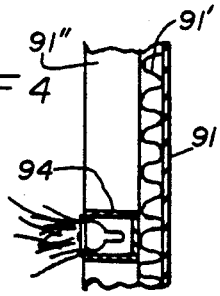
FIG. 4
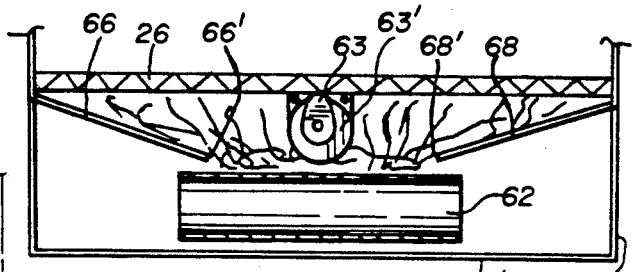
FIG. 5
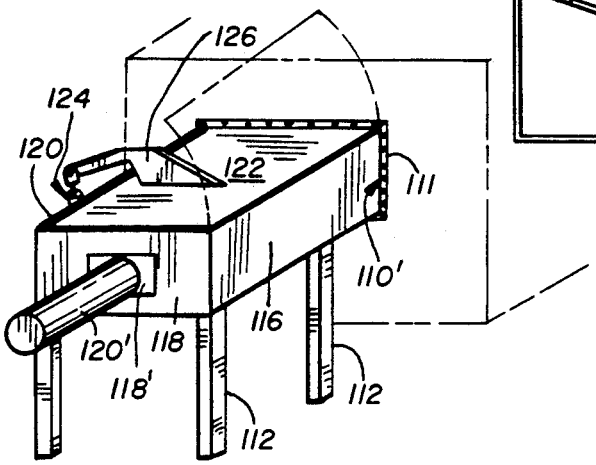
FIG. 7
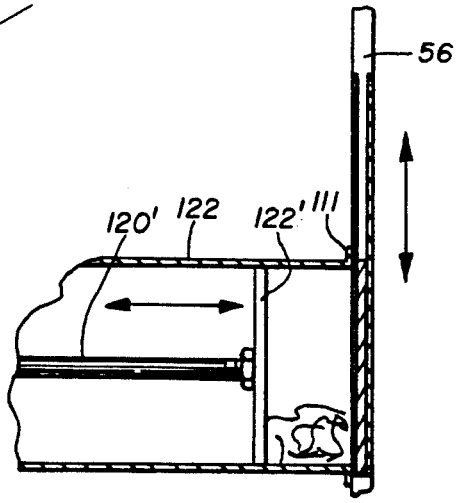
FIG. 6
FIG. 8
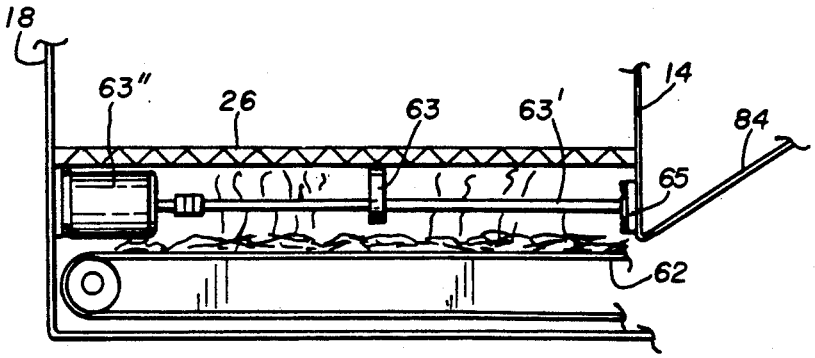

STAND-ALONE, COMMERCIAL REFUSE-BURNING APPARATUS

BACKGROUND OF THE INVENTION

The present invention is directed to a method and apparatus for burning refuse, such as wood waste, and the like, in an environmentally safe manner, which meets all standards set by local, state and federal agencies. In U.S. Pat. No. 5,050,509 there is disclosed a system for commercially burning waste products, such as wood waste, such as leaves, branches, etc., in which a burn-box is provided, which burn box serves as a combustion chamber. The upper perimeter of the burn-box is enveloped, or covered over, by a curtain of air that prevents the smoke and other products of combustion from escaping into the atmosphere while combustion takes place, thus providing a waste-disposal system that is essentially pollution-free. While the system of this patent performs satisfactorily to provide a clean and safe burning of refuse and waste, it may occur that the combustion within the burn-box combustion chamber will not be complete, thereby leaving over solid remnants that would otherwise be preferred to have burned and turned into ash. The present invention ensures that all of the combustible material making up the refuse and waste is thoroughly burned and turned into ash, and that the smoke and fumes generated meet all federal, state and local clean-air, environmental standards, so that such products of combustion may be exhausted into the ambient surroundings.

SUMMARY OF THE INVENTION

It is the primary objective of the present invention to provide a system for burning refuse and waste in a safe, pollution-free manner.

It is, also, an objective of the present invention to provide such a safe, pollution-free system that allows for the relatively self-cleaning thereof.

It is yet another objective of the present invention to provide such a system that is easily and safely loaded with refused and waste to be burned.

Toward these and other ends, the refuse-burning apparatus of the invention has a main combustion housing having an interior in which refuse is placed and burned, which main combustion housing has a plurality of substantially upright walls, a top wall, and a bottom wall with a meshed screen positioned thereabove. One side wall has an entrance through which refuse may enter into the interior of the housing, which entrance is selectively opened and closed. A loader for loading refuse into the interior of the housing is operatively associated with the entrance, so that refuse may be inserted into the interior when the entrance is opened up. A ventilator supplies air to the interior. An after-burner chamber is mounted on the top wall of the main housing for achieving secondary burning of the refuse remains. At least one burner is mounted to a secondary chamber, and an exhaust pipe for directing the products of combustion from the main frame to the ambient surroundings. The after-burner's main frame has a shield having at least one portion thereof diametrically opposite to the burner. The shield is mounted in the main frame at an acute angle with respect to the vertical, and has a lower end in close proximity to the entrance of the top wall, and an upper end. When the products of combustion rise from the interior of the main housing through the entrance of the top wall, any solid particles contained therein will strike against the shield and be prevented from escaping with the exhaust. The flames from the burner and the air currents generated thereby force the solid particles toward the shield, and thereby down the shield back into the interior of the main housing through the entrance in the top wall. Since the shield has a surface exposed to the flames of the after-burner, these solid particles and particulates are also more thoroughly burned.

In a first embodiment, the means for selectively opening and closing the reclosable entrance is a first door, and the loader for loading refuse into the interior of the housing is a conveyer for conveying refuse toward and into the interior of the main housing. The loader has a second door that is vertically reciprocal, which second door has a bottom edge-surface. The second door is horizontally spaced from the first door in a direction along the conveyer, and there is provided means for reciprocating the second door so that the bottom edge-surface is moved toward and away from the conveyer. The second door is closed when the first door is opened. In a second embodiment, a ram replaces the conveyer for forcing the refuse into and through the reclosable entrance.

In the preferred embodiment, the bottom meshed screen is periodically vibrated to loosen any ash adhered thereto. Mounted underneath the meshed screen is an exit conveyer for transporting the ashes falling through the meshed screen to a receiving receptacle for subsequent disposal of the ash. A pair of sloping deflector plates direct the ashes onto the conveyer belt. The receiving receptacle has a series of magnetized baffle plates for separating out metal objects from the ashes and holding them for the separate disposal thereof.

BRIEF DESCRIPTION OF THE DRAWINGS

The invention will be more readily understood with reference to the accompanying drawing, wherein:

FIG. 3 is a cross-sectional, detail view of the outer wall of the main combustion chamber;

FIG. 4 is a cross-sectional, detail view of the outer wall of the after-burner;

FIG. 5 is an end view showing the bottom meshed screen of the main combustion chamber in cooperation with the exit-conveyer and deflector plates for periodically removing ash from the main combustion chamber;

FIG. 6 is an elevational, cross-sectional view of the exit-conveyer and the shaft with eccentric cam for vibrating the meshed screen to dislodge ash and other particles therefrom to cause them to fall upon the conveyer belt therebelow;

FIG. 7 is a perspective view showing a modification of the refuse-loading equipment for feeding refuse and waste into the main combustion chamber for burning: and FIG. 8 is a cross-sectional view, in elevation, of the ram-loader of FIG. 7, and showing the reclosable door of the main combustion chamber in conjunction with the ram-loader.

DETAILED DESCRIPTION OF THE INVENTION

Figure 1:
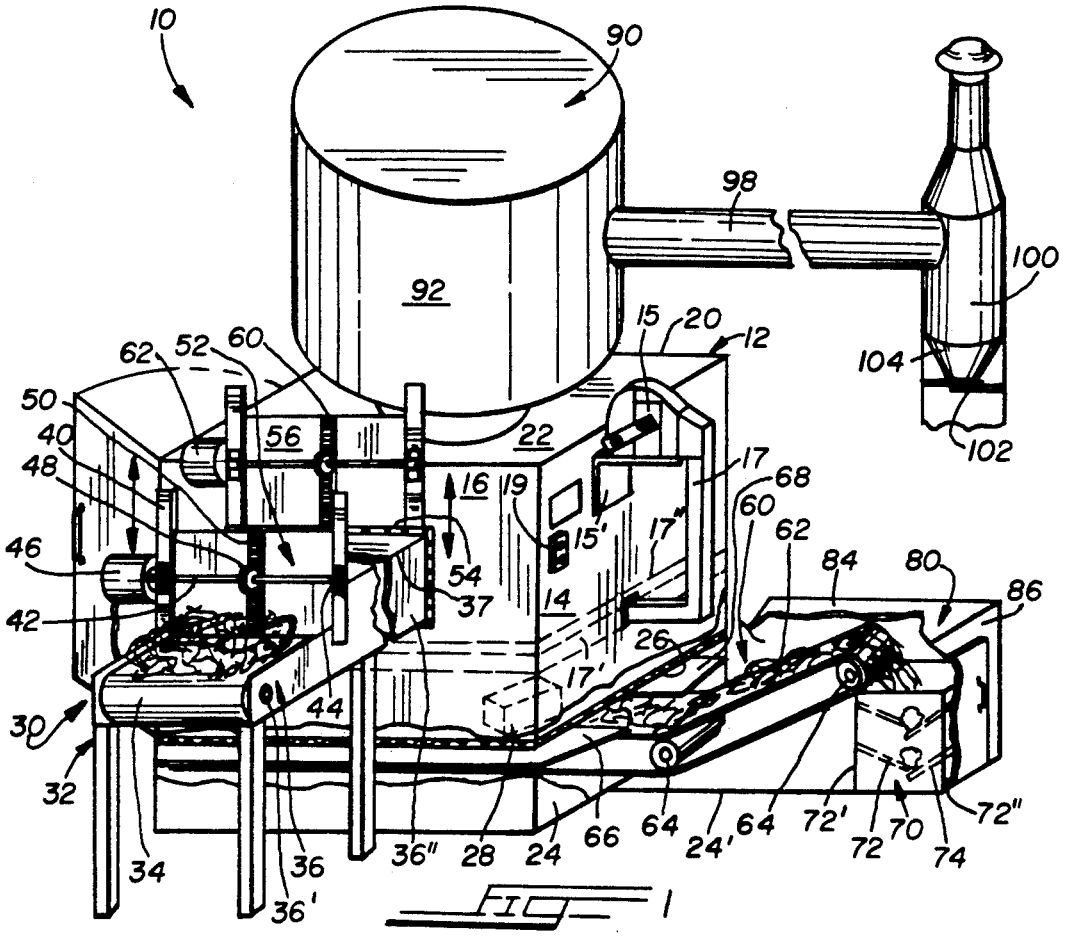
FIG. 1 is a perspective view showing the stand-alone, refuse-burning apparatus of the invention.

Referring now to the drawings in greater detail, the stand-alone, refuse-burning apparatus of the invention is indicated generally by reference numeral 10. The apparatus 10 has a substantially, quadrilateral-shaped main housing 12 made up of four vertical walls 14, 16, 18, 20, a top wall 22, and a bottom wall 24 best seen in FIG. 5. As shown in FIG. 3, each wall is made of a ¼-inch thick, outer steel layer 19, a 3-inch thick intermediate layer 19' insulating refractory, and a 2 to 6-inch thick, interior layer 19'' of super-duty refractory. The housing 12 defines an enclosed, hollow interior serving as a combustion chamber in which are burned refuse and waste products, such as wood, by-products thereof, and the like. The side wall 18 is hinge-mounted at one end to serve as an access door, in order to access into the interior of the housing for periodic cleaning or repair. The side wall 14 mounts a conventional ventilation fan 15 via bracket-mount 15'. A duct 17 leads the forced air into the interior of the housing 12 via a cutout formed in the wall 14, as seen in FIG. 1. In the interior of the housing, the duct bifurcates into two branches 17', 17'' provided with air outlets, which branches extend about the entire perimeter of the interior wall surfaces of the housing, in order to provide an ample supply of fresh air for serving the combustion process. The construction of the branches 17', 17'' with air outlets are similar to those disclosed in U.S. Pat. No. 5,050,509. The lower portion of the interior of the housing 12 has a grate-member, or meshed screen, 26 upon which the refuse is placed while ignition thereof occurs by means of a pair of conventional ignitors 28, which are mounted to the interior surfaces of the walls 14,16,18,20, with only one ignitor being shown in the drawing for clarity. In the preferred embodiment, two such conventional ignitors are provided at diametrically-opposite corners. The ignitors are mounted at the corners in the interior ensure optimal ignition, and are preferably mounted above the meshed screen 26, with their flames of ignition being directed toward each other in the horizontal plane, when viewing FIG. 1. Control panel 19 is mounted on wall 14, for controlling all of the electrical components of the apparatus 10. The ignitors 28 and the meshed screen 26 are mounted below the air-outlet branches 17', 17'', so that vertical air currents are produced that draw the smoke and exhaust from the burning refuse upwardly, for the reasons discussed below in detail.

The refuse is caused to be placed on the grate-member 26 via a conveyer system 30. The conveyer system 30 includes an upright conveyer stand 32 supporting a conveyer belt 34 via rollers in a conventional manner. The stand 32 has a pair of side plates 36. Each side plate has a forward portion 36' which is lower in height than a rear portion 36''. The forward edge-surface of each rear portion 36'' is thicker than the forward portion 36', by which a vertically-oriented mounting plate 40 is supported, as clearly seen in FIG. 1. A top wall 37 closes off the space between the two rear portions 36'', to thus provide a feed-chute for the refuse. Each mounting plate 40 has a vertical, central groove in which is guided a lateral edge of a door, as described below, which door abuts against the forward edge-surface of the top wall 37, in order to ensure that no gases or fumes escape from the interior of the housing, as explained below. The two mounting plates 40 rotatably support a drive shaft 42 via bearing 44, which drive shaft is powered by a motor/reduction gear arrangement 46. In the middle of the drive shaft 42 there is mounted a pinion 48 for conjoint rotation, which pinion meshes with a rack 50 secured to a door 52 mounted for vertical, sliding movement in the two support plates 40. The door 52 has a width slightly less than the distance between the two plates 36, so that when the door is completely lowered, it prevents the refuse on the conveyer belt 34 from extending therepast. The wall 16 of the housing 12 is provided with a cooperating, refuse-infeed entrance 54 that is closed via a vertically, reciprocally mounted door 56, shown somewhat clearly in FIG. 1, and best seen in FIG. 8. The door 56 is reciprocated vertically by a rack-and-pinion arrangement 60 and motor 62, which is similar to that for the door 52. Whenever the outer door 52 is opened, the inner door 56 is closed, to ensure that no exhaust smoke, fumes or particles exit from the interior of the housing 12. Moreover, whenever the inner door is opened, the outer is closed for the same reason. Since the rear portions 36'' and top wall 37 form a closed feed-chute for the refuse, there is no avenue of escape for the exhaust, fumes, and particles. In loading refuse into the interior of the housing 12, the outer door 52 is first opened, and the inner door 56 kept closed. The conveyer belt 34 is activated to convey the refuse piled thereon into the region between the two doors. When enough has been piled up between the two doors, the conveyer is stopped, and the front, or outer, door is closed. Thereafter, the rear, or inner, door is opened, and the conveyer started again, to cause the refuse to enter through the entrance 54 and, thereby, fall down onto the grate-member 26. Then, the inner door is closed, and the refuse is ignited by means of ignitors 28. The rear edge-surfaces of the rear portions 36'' of the stand 32 substantially extend into close, abutting juxtaposition to the exterior of the inner door 52, and secured to the surrounding portions of the wall 16, so that the conveyer belt 34 reaches right up to the entrance 54, to ensure that the refuse, and other waste products, are forced through the entrance 54 after the inner door 56 has been opened.

As stated above, the mesh screen 26 receives and supports the waste thereon during ignition and combustion. The ashes, residue, and other particles left over from the combustion must, at least periodically, be removed from the housing. Toward this end, there is provided an exit-conveyer system 60 made up of an endless conveyer belt 62. The conveyer belt 62 is mounted below the meshed screen 26 and above the bottom wall 24, and has a length extending entirely across the length of the meshed screen, so that the ashes and other residue will fall through the meshed screen 26 and directly onto to the endless belt 62, as best seen in FIGS. 1, 5 and 6. Rollers 64 mounted by the housing 12 rotatably support the endless belt for movement. Mounted between the upper, conveyer-surface of the belt 62 are a pair of deflector plates 66, 68, which plates extend angularly-downwardly from opposite edges of the meshed screen. The two plates 66, 68 terminate in outer edge-surfaces 66', 68', which edge-surfaces are spaced from each other to define a gap through which the falling ashes and particles pass to the conveyer belt 62. The deflector plates 66, 68 ensure that all of the ashes and particles passing through the meshed screen 26 are directed onto the conveyer belt's upper surface, for removal thereby. The width of the conveyer belt 62 is greater than the gap between the edge-surfaces 66', 68'. Mounted directly beneath the meshed grate 26 is an elongated, rotatable, eccentric cam 63. The cam 63 is mounted for rotation by means of an elongated shaft 63' supported by a mounting bracket 65 secured to the side wall 14 in the space between the endless belt 62 and the meshed screen 26. For each complete rotation of the shaft 63', the eccentric portion of the cam 63 strikes against the meshed screen 26 in order to shake or vibrate the screen, in order to dislodge all ash and other residue stuck therein. The eccentric cam 63 and shaft 63' is rotated by a motor 63'' mounted on the interior surface of the vertical wall 18, as seen in FIG. 6.

The conveyer 60 terminates past the side wall 14, as seen in FIG. 1, for dumping the ashes thereon into a receptacle 70. The portion of the conveyer 60 outwardly of the side wall 14 rises slightly at an acute angle, so that the bottom of the receptacle 70 and the bottom wall 24 of the housing may be coplanar and supported on the same supporting surface. The receptacle 70 is provided with a first series of downwardly-angled, parallel baffle plates 72 projecting from a first side wall 72', and a second series of parallel baffle plates 74 projecting from a second side wall 72''. Each baffle plate 74 overlaps a corresponding baffle plate 72, as best seen in FIG. 1, so that solid objects may be caught or trapped by overlapping ends of baffle-plate pairs 72, 74. In the preferred embodiment, each baffle plate 72, 74 is magnetized, in order to attract and hold metal objects thereto, in order to separate out metal objects from the ash, and to allow for easier, subsequent disposal thereby.

The entire conveyor system 60, deflector plates, and receptacle 70 are completely closed off to the immediate, surrounding environment by means of the housing 12, and particularly the bottom wall 24 of the housing 12, and an auxiliary extension 80 of the housing, which auxiliary housing includes an extension 24' of the bottom wall 24, upstanding side walls 82, a top wall 84, and an end wall 86. End wall 86 is provided with an access opening by which the interior of the auxiliary housing 80 is accessed, in order to remove and empty the receptacle 70, and in order to clean out other interior parts of the conveyor system 60. The width of the auxiliary housing 80 is the same as the width as of the housing 12 as defined by the width of the side wall 14.

Figure 2:
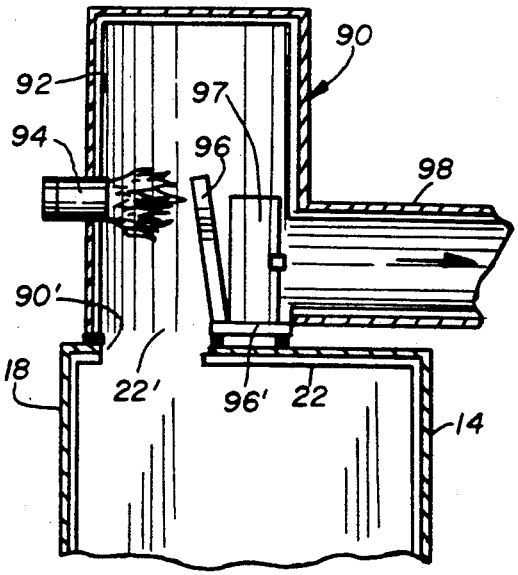
FIG. 2 is a vertical, cross-sectional view thereof showing the after-burner in communication with the interior of the main combustion chamber.

The housing 12 mounts, on top wall 22 thereof, an after-burner chamber device 90. The top wall 22 has an opening 22' which cooperates with a lower opening 90' of a cylindrical housing 92 of the after-burner device 90, as best seen in FIG. 2. As seen in FIG. 4, the housing 92 has walls made of three layers: A ¼-inch thick, outer, steel layer 91, a 2-inch thick, intermediate layers 91' of insulating refractory, and a 2 to 6-inch thick, interior later 91'' of super-duty refractory. The fumes, exhaust and other products of combustion from the burned refuse in the combustion chamber of housing 12 are all forced up through the openings 22', 90', by the convection currents created by the air-outlets of the air-ducts 17', 17'', as described above, as well as by updraft via the viscous air flow created by the fire from ignitors 28 and the burning refuse. The main purpose of the after-burner device 90 is to re-burn all of the exiting, rising exhaust and products of combustion within the interior chamber of the housing 92 of the after-burner device, in order to ensure that the exhaust that is spewed out to the outside, ambient surroundings is clean and meets all of the clean-air requirements of federal, state, and local law and regulations. The housing 92 mounts a conventional after-burner 94 in a vertical wall-portion thereof, above the entrance-opening 90'. The exhaust and other products of combustion rising through the openings 22', 90' will be immediately exposed to the flames of the after-burner 94, so that all solid particles and particulates are thoroughly burned, and ensures that the exhaust is heated to a sufficiently and significantly high temperature in order to break down any potentially toxic gas. Mounted within the interior of the housing 92, and operatively associated with the opening 90' thereof, is a deflector 96 that is mounted at an acute angle with respect to the vertical, as seen in FIG. 2. The deflector 96 is a wide, flat plate extending the full width, or diameter, of the housing 92, and is mounted by a bracket-mount 96' to the top wall 22. As the exhaust and products of combustion rise through the opening 90' into the interior of the housing 92, any solid particles, particulates, and ash entering into the interior of the housing 92 will strike against the deflector 96. The deflector will prevent them from escaping therepast, to thereby effectively prevent their exit to the ambient surroundings. This is accomplished by virtue of the fact that the deflector extends from the after-burner 94 and downwardly. The acute-angle mounting of the deflector ensures that all of the solid particulates, and the like, and the exhaust and fumes are forced upwardly and inwardly into close proximity to the after-burner 94, whereby it is guaranteed that the flames from the after-burner will contact them, to burn them up, and so that the deflector itself is exposed to the flames of the after-burner. A door 97 is provided in the cylindrical wall of the housing 92 in order to allow access to the interior, for cleaning and repair. The housing 92 has an exit, or outlet, exhaust-conduit 98 leading to a conventional chimney stack 100, from which the exhaust is delivered to the ambient surroundings. The height of the deflector 96, and the position of the after-burner 94, are both above the conduit 98, so that the exhaust must travel a circuitous route, in order to ensure solid particles do not escape, as explained above. The chimney 100 has clean out gates 102 that lead to a particulate-collection chamber 104 for cleaning.

FIGS. 7 and 8 show an alternative embodiment for the refuse-delivery system. In this version, there is provided a table 110 supported on legs 112. The table is provided with a top, supporting surface 114 upon which the refuse is placed. One end 110' of the table is affixed to the wall 16 of the housing 12 via mounting lip 111 in alignment with the entrance opening 54 of the wall 16. The table top 114 is surrounded and enclosed by three vertical walls 116, 118, 120, and a top, horizontal wall 122. The top wall 122 is pivotally mounted to the upper edge-surface of the vertical wall 120, so that it may be opened for inserting refuse therein, and, thereafter, closed. The top wall 122 is powered by a piston-cylinder assembly 124 that pivots a cantilevered support-arm 126 secured at one end to the top wall 122, whereby the top wall may be alternatively opened or closed. The vertical end-wall 118 has an opening 118' formed therein through which passes and projects a rod 120', to the interior end of which is secured a ram-head 122', whereby a ram is provided for forcing the refuse along the table top 114 toward the wall 16 and through the opening 54 thereof. The door 56 for the opening 54, when opened, allows for the refuse to be pushed into the interior of the housing 12, in the same manner as described above for the first embodiment. Since the ram-head 122' is always sealed with respect to the exterior of the table, whenever the door 56 is opened, smoke cannot escape to the ambient surroundings.

In the preferred form of the device 10 of the invention, the main housing 12 has an interior length of 12 feet, six inches, which length is the length of the wall 16. The housing 12 has an interior width of 6 feet, 8 inches, and an interior height of 6 feet, 8 inches, to thereby provide a 685 cubic feet, interior, receiving capacity. The housing 92 of the after-burner device 90 has an inner height 10 feet, 6 inches, and an inner diameter of 7 feet, for a total, interior capacity of 407 to 1800 cubic feet. The openings 22' and 90' are preferably 4 feet in length. The exhaust-conduit 98 has an interior diameter of 36 inches.

While a specific embodiment of the invention has been shown and described, it is to be understood that numerous changes and modifications may be made therein without departing from the scope, spirit and intent of the invention as set forth in the appended claims.

What I claim is:

1. A refuse-burning system comprising:

a main combustion-housing having an interior in which refuse is placed and burned;

said main combustion-housing comprising a plurality of substantially-upright walls, a top wall, and a bottom wall;

at least one of said walls having a entrance through which refuse may enter into said interior of said combustion-housing;

means for selectively opening and closing said entrance of said at least one of said walls;

loading means for loading refuse into said interior of said combustion-housing, said loading means being operatively associated with said entrance of said at least one of said walls, so that refuse may be inserted into said interior when said entrance is opened by said means for selectively opening and closing;

ventilation means for supplying air to said interior; and after-burner means mounted to said main housing for the secondary burning of the refuse, said after-burner means comprising a main frame, at least one burner mounted by said main frame, and exhaust means for directing products of combustion from said main frame to the ambient surroundings;

one of said walls of said main combustion-housing having an opening in fluid communication with the interior of said main frame for directing smoke into said main frame;

said entrance being formed in one of said substantially upright walls, and said main frame of said after-burner means being mounted above said top wall; said main combustion chamber having an opening in fluid communication with the interior of said main frame for directing products of combustion into said main frame; said main combustion-housing further comprising at least one igniter for igniting the refuse in said interior;

said at least one burner of said after-burner means being mounted in a vertical wall portion of said main frame thereof; said main frame comprising a shield having at least one portion thereof diametrically opposite to said at least one burner, so that the flames of said at least one burner contact said at least one portion of said shield.

2. The refuse-burning system according to claim 1, wherein said means for selectively opening and closing said entrance of said at least one of said walls comprises a first door, and means for moving said door into and out of said entrance; said loading means for loading refuse into said interior of said combustion-housing comprising a conveyer for conveying the refuse toward said entrance and into said interior of said combustion-housing, and a second door vertically reciprocal relative to said conveyer, said second door having a bottom edge-surface and being horizontally spaced from said first door in a direction along said conveyer; and means for reciprocating said second door for moving said bottom edge-surface toward and away from said conveyer, said first door being in its closed, downward position with said bottom edge-surface against said conveyer when said second door is opened.

3. The refuse-burning system according to claim 1, wherein said means for selectively opening and closing said entrance of said at least one of said walls comprises a door, and means for moving said door into and out of said entrance; said loading means for loading refuse into said interior of said housing comprising a substantially-closed, refuse-holding structure having a discharge outlet operatively juxtapositioned to said entrance, and a ram operatively associated with the interior of said refuse-holding structure for forcing the refuse toward said discharge outlet and said entrance, and into said interior of said main combustion-housing when said door is opened, and means for forcibly sliding said ram toward and away from said entrance.

4. The refuse-burning system according to claim 3, wherein said refuse-holding structure comprises a door for allowing access into the interior of said refuse-holding structure for loading refuse therein.

5. The refuse-burning system according to claim 1, wherein said main combustion-housing also comprises a meshed screen above said bottom wall through which may pass ashes formed during the combustion of refuse in said interior of said main combustion-housing; and means mounted below said meshed screen and above said bottom wall for collecting the ashes falling through said meshed screen.

6. The refuse-burning system according to claim 5, wherein said means mounted below said meshed screen for collecting the ashes falling through said meshed screen comprises a conveyer and a container at the end of, and in operative communication with, said conveyer, said conveyer transporting ashes away from the main combustion-housing toward said container for placement in said container.

7. The refuse-burning system according to claim 6, wherein said container comprises baffle plates for separating out solid particles from the ashes.

8. The refuse-burning system according to claim 7, wherein said baffle plates are magnetized for attracting metal objects for separating out metal objects from the ashes.

9. The refuse-burning system according to claim 5, wherein said means mounted below said meshed screen for collecting the ashes falling through said meshed screen comprises a collecting surface, and a pair of oppositely-mounted, downwardly-sloping, directing plates, the ends of said directing plate being spaced apart a distance to allow for the passage therethrough of ashes exiting through said meshed screen; said collecting surface being positioned vertically below said directing plates and having a width at least as great as said distance that said directing plates are spaced apart, so that the ashes exiting through the meshed screen fall thereupon.

10. The refuse-burning system according to claim 5, further comprising means for periodically shaking said meshed screen in order to dislodge out ash caught therein.

11. The refuse-burning system according to claim 10, wherein said means for periodically shaking comprises a rotatable, eccentric cam having an eccentric portion, and a cam shaft for rotatably mounting said cam, said cam being mounted below said meshed screen a distance such that, upon one complete rotation of said cam, said eccentric portion contacts against a portion of said meshed screen juxtapositioned thereabove.

12. The refuse-burning system according to claim 1, wherein said shield is mounted in said main frame at an acute angle with respect to the vertical, and comprises a lower end in close proximity to said entrance of said top wall, and an upper end comprising said at least one portion, whereby, when the exhaust rises from said interior of said main combustion-housing through said entrance of said top wall, any solid particles contained therein will strike against said shield and be prevented from escaping with the exhaust through said exhaust means, with the flames from said at least one burner and the air currents generated thereby forcing solid particles toward said at least one portion of said shield.

13. A refuse-burning apparatus comprising:

a main combustion-housing having an interior in which refuse is placed and burned;

said main combustion-housing comprising a plurality of substantially-upright walls, and a top wall;

at least one of said walls having a entrance through which refuse may enter into said interior of said combustion-housing;

ventilation means for supplying air to said interior; and after-burner means mounted to said main housing for the secondary burning of the refuse, said after-burner means comprising a main frame, at least one burner mounted by said main frame, and exhaust means for directing smoke from said main frame to the ambient surroundings;

one of said walls of said main combustion-housing having an opening in fluid communication with the interior of said main frame for directing smoke into said main frame;

said at least one burner of said after-burner means being mounted in a vertical wall portion of said main frame; said main frame comprising a shield having at least one portion thereof diametrically opposite to said at least one burner; said shield being mounted in said main frame at an acute angle with respect to the vertical, and comprising a lower end in close proximity to said entrance of said at least one wall, and an upper end comprising said at least one portion, whereby, when the products of combustion rise from said interior of said main combustion-housing through said entrance, any solid particles container therein will strike against said shield and be prevented from escaping with the exhaust through said exhaust means, with the flames from said at least one burner and the air currents generated thereby forcing solid particles toward said at least one portion of said shield.

14. A refuse-burning system comprising:

a main combustion-housing having an interior in which refuse is placed and burned;

said main combustion-housing comprising a plurality of substantially-upright walls, a top wall, and a bottom wall;

at least one of said walls having a entrance through which refuse may enter into said interior of said combustion-housing;

means for selectively opening and closing said entrance of said at least one of said walls;

loading means for loading refuse into said interior of said combustion-housing, said loading means being operatively associated with said entrance of said at least one of said walls, so that refuse may be inserted into said interior when said entrance is opened by said means for selectively opening and closing;

ventilation means for supplying air to said interior;

said main combustion-housing also comprising a meshed screen above said bottom wall through which may pass ashes formed during the combustion of refuse in said interior of said main combustion-housing; and means mounted below said meshed screen and above said bottom wall for collecting the ashes falling through said meshed screen;

said means mounted below said meshed screen for collecting the ashes falling through said meshed screen comprising a conveyer and a container at the end of, and in operative communication with, said conveyer, said conveyer transporting ashes away from the main combustion-housing toward said container for placement in said container;

said container comprising a first wall, and a second opposite and parallel side wall, a first series of parallel, downwardly-angled baffle plates extending from said first side wall of said container, and a second series of parallel, downwardly-angled baffle plates extending from said second side wall of said container, each of said baffle plates of said first series overlapping a corresponding said baffle plate of said second series, so that solid objects may be trapped for separating out solid objects from ashes.

15. The refuse-burning apparatus according to claim 14, wherein each of said baffle plates of said first and second series are magnetized for attracting metal objects for separating out metal objects from the ashes.

* * * * *